United States Patent [19]

Demuth

[11] 3,939,877

[45] Feb. 24, 1976

[54] WEAVING MACHINE HAVING A BORDER FORMING MEANS

[75] Inventor: Hans Demuth, Winterthur, Switzerland

[73] Assignee: Sulzer Brothers Limited, Winterthur, Switzerland

[22] Filed: Nov. 1, 1973

[21] Appl. No.: 411,928

[30] Foreign Application Priority Data

Nov. 3, 1972 Switzerland ..... 16022/72

[52] U.S. Cl. ..... 139/54; 139/122 S; 139/194; 277/30

[51] Int. Cl.[2] ..... D03D 47/40

[58] Field of Search ..... 139/54, 25, 116, 194, 126, 139/55, 57, 68, 291, 122 S; 197/40; 74/606, 608; 277/30, 89, 93

[56] References Cited

UNITED STATES PATENTS

| | | | |
|---|---|---|---|
| 1,967,842 | 7/1934 | Raviola et al. | 277/30 |
| 3,040,782 | 6/1962 | Pfarrwaller | 139/126 |
| 3,174,515 | 3/1965 | Luber | 139/302 |
| 3,441,059 | 4/1969 | Gotz et al. | 139/194 |
| 3,603,359 | 9/1971 | Piazzolla | 139/57 |
| 3,704,019 | 11/1972 | McHugh | 277/89 |

*Primary Examiner*—Henry S. Jaudon
*Attorney, Agent, or Firm*—Kenyon & Kenyon Reilly Carr & Chapin

[57] ABSTRACT

The means for forming a fabric border is constructed with a cover to cover over the opening in the housing through which the operating element projects. The cover is formed by flange projections on the drive means for moving the operating element or by a separate sleeve-like part having a flanged appendage on the operating element. The cover is intended to prevent dust and lint from entering the housing.

12 Claims, 5 Drawing Figures

Fig. 3
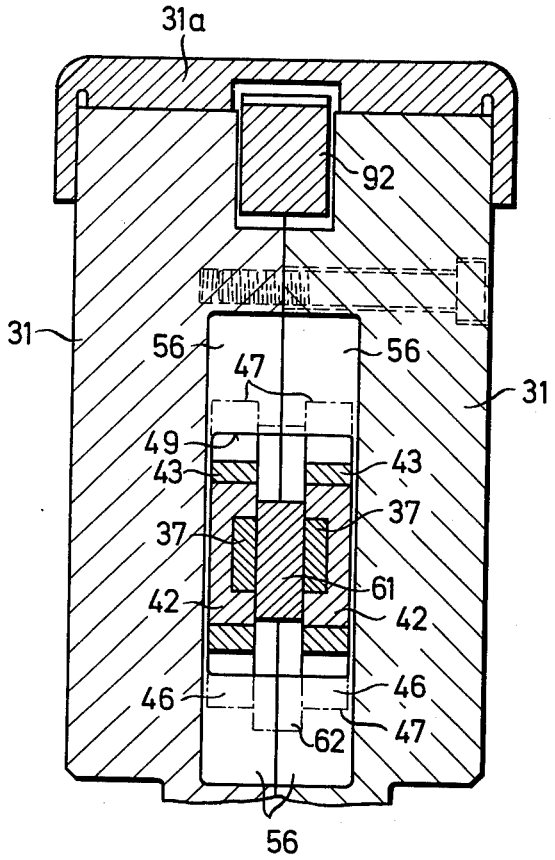
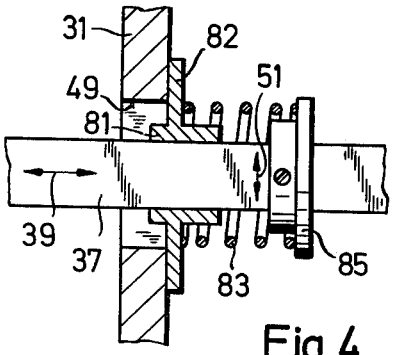
Fig.4
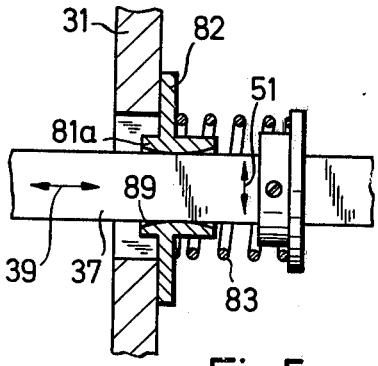
Fig.5

WEAVING MACHINE HAVING A BORDER FORMING MEANS

This invention relates to a weaving machine having a border forming means.

Heretofore, weaving machines have been provided with various means for forming a border of turned over weft thread ends along the edges of a fabric being produced. Generally, these means have included a housing with one or more openings through which an operating element projects. The operating element has usually been a rod for operating a border-thread clamp or a lever for cutting the weft threads. In either case, the operating element has been moved approximately transversely of the opening during the operation of a drive means.

Because of this, the opening has been made large enough for the transverse movement of the operating element to take place. The opening, moreover, has been unobstructed around the operating element. As a result, during operation or when the weaving machine is cleaned, dirt, e.g. fibrous lint from the fabric can get into the border-forming housing. This has lead to disturbances in the operation of the parts and in the lubrication of the parts from an oil supply.

Accordingly, it is an object of the invention to provide a means for preventing the entry of dirt into a housing of a border-forming means.

It is another object of the invention to provide a simple economical means for closing off a housing of a border-forming means in a weaving machine.

Briefly, the invention is directed to a weaving machine having a means for forming a fabric border of turnedover weft thread ends. The means is constructed with a housing having at least one opening through which an operating element extends to project into the path of a weft extending across the loom. The operating element can be in the form of a rod, e.g. for operating a border thread clamp, or a lever, e.g. for cutting the weft thread ends. This operating element is movably mounted in the housing and is driven by a drive means in order to move transversely of the housing opening. In accordance with the invention, a cover means is disposed about the operating element for covering over the opening for every transverse position of the operating element.

In one embodiment, where the drive means for the cover means also projects out of the opening of the housing, the cover means is incorporated in the drive means to not only cover over the opening with respect to the operating element but also with respect to the drive means. Further, where the operating element is caused to reciprocate, provision is made for the element to slide within the drive means. In this way, the cover means on the drive means need not be modified to accomodate the reciprocating movements of the operating element.

In another embodiment, for example, where only the operating element extends out of the housing, the cover means is secured to the operating element. In this case, the cover means can be resiliently biased against the housing to slide on the housing while the operating element moves up and down.

In order to facilitate the sealing effect of the cover means, the opposed surfaces of the housing and cover means may be suitably rounded or otherwise matched to compensate for the arcuate movements of the operating element relative to the housing.

The cover means thus prevents dirtying of the part inside the border-forming housing, e.g. such dirtying as might occur during cleaning of the weaving machine by blown compressed air.

These and other objects and advantages of the invention will become more apparent from the following detailed description and appended claims taken in conjunction with the accompanying drawings in which:

FIG. 3 illustrates a view taken on line III—III of FIG. 2;

FIG. 4 illustrates a view of a modified cover means according to the invention; and FIG. 5 illustrates a view similar to FIG. 4 of a further modified cover means according to the invention.

Figure 1:
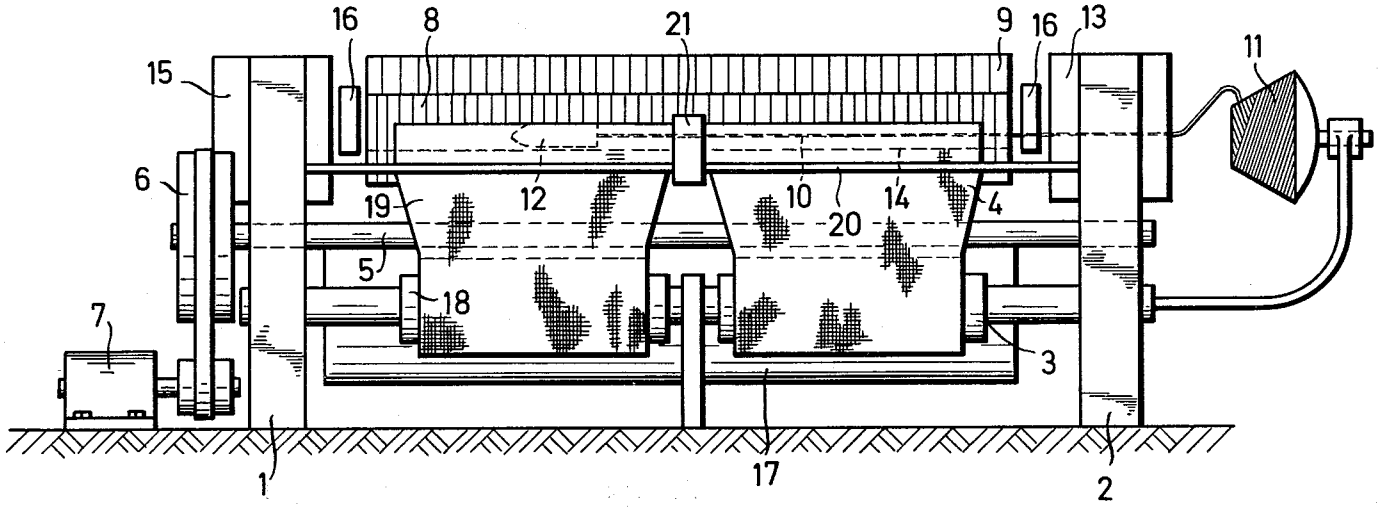
FIG. 1 illustrates a front view of a gripper-shuttle weaving machine having border forming means therein according to the invention.

Referring to FIG. 1, the weaving machine, as is known, has a pair of side cheeks or frame 1, 2 which are connected together by a middle beam. Between the cheeks 1, 2 are disposed a warp beam 17, shafts 9, a reed 8, and a fabric beam consisting of two part-beams 3, 18. One cheek 2 carries a shuttle mechanism 13 out of which shuttles 12 are shot to pass through a guideway 14 in the shed. Each shuttle 12 which is shot carries a weft-thread 10 which is pulled off a supply spool 11. The other cheek 1 carries a catching mechanism 15 for catching the shuttles 12. The weaving machine also includes a drive-motor 7, whose drive is carried through the intermediary of a flywheel 6 to a main shaft 5 of the machine. All mobile parts, e.g. the shafts 9, reed 8, shuttle mechanism 13, and catching mechanism 15, are driven off the main shaft 5 in synchronism.

In addition, a border forming device 16 is disposed near each of the shuttle mechanism 13 and the catching mechanism 16. Similarly, a separating border-forming device 21 is disposed in the middle of the machine on the rod 20 in order to form borders on the inner edges of the two fabric webs 4, 19 as shown. The devices 16, 21 which are operated as described in more detail in the following serve to insert the ends of the weft threads shot through one shed into the following shed, so that fabric borders are formed at the edges of the fabric webs 4, 19. The edge-border or selvage forming devices 16 and the separating-border or selvage forming device 21 are substantially similar. In the following, only one of these parts will be described.

The above described parts of the weaving machine are of conventional structure and are operated in known manner. Therefore, no further description is believed to be necessary for an understanding of the invention.

Figure 2:
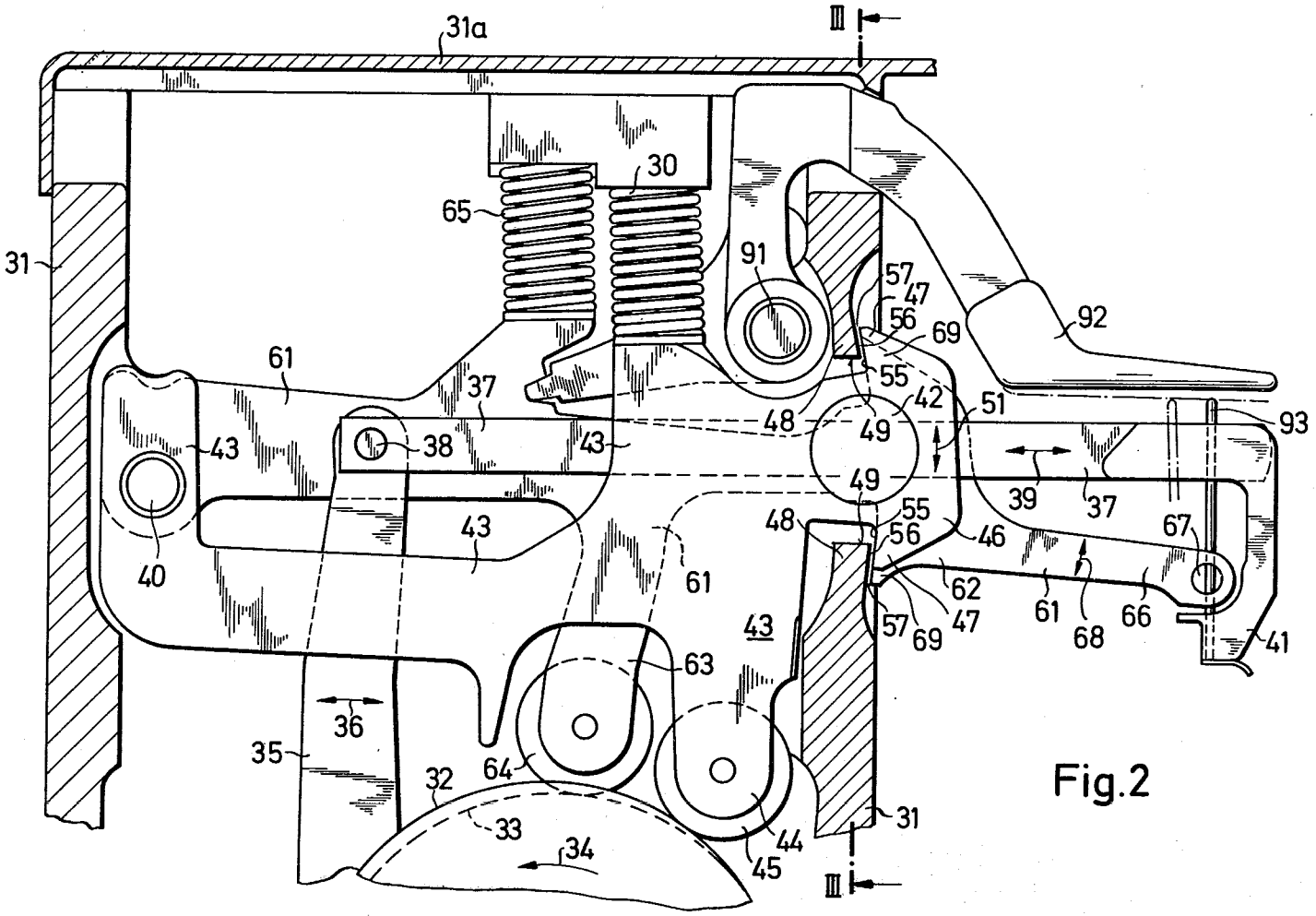
FIG. 2 illustrates a sectional side view through a border forming means which utilizes a cover means in accordance with the invention.

Referring to FIGS. 2 and 3, the separating border forming device 21 includes a housing 31 having a cover **31*a* on the top. The various inner working parts of the device 21 are driven by a suitable driven means e.g. off the main shaft 5 in known manner via cam discs of which only two discs 32, 33 are shown for clarity. These cam discs 32, 33 rotate in the direction indicated by the arrow 34. In addition, the drive means includes a lever 35 which is movable in a to and fro manner as indicated by the arrow 36 and which is connected to a pair of operating elements such as bars or rods 37. The rods 37 are each articulated at one end to the lever 35 via a pin 38 and extend out of the housing 31 via an opening 49. The opposite free ends of each rod 37 carries a border thread clamp 41 as is known. As indicated by the arrow 39, the rods 37 are caused to reciprocate longitudinally under the action of the lever 35 with the thread clamps 41 making the same movement. The thread clamps 41** serve to grip a weft thread after insertion in a shed for further operations as are known.

The drive means also includes a pair of roller levers 43 (so designed a number of times for clarity) which are pivotable about a stationary journal 40 in the housing 31. Each lever 43 carries a rotatable slide disc 42 which is of circular form and which is slotted (FIG. 3) to slidably receive a rod 37. As shown, the slide disc 42 is mounted within the plane of the opening 49. The roller levers 43 also have an appendage 44 which supports a roller 45. Each roller lever 43 has a cover means 46 thereon in the form of a pair of flange projections 47 which define a trapezoidal-shaped enlargement of the lever 43. Each projection 47 extends over the housing parts 48 which form the opening 49 for the passage of the border thread clamp rods 37. The roller 45 is biased into contact with a cam disc 32 under the force of a spring 30 which is mounted between the housing 31 and the levers 43.

During operation, each rod 37 is caused to reciprocate via the lever 35 and to pivot as indicated by the arrow 51 on the pin 38 due to a transverse motion of the roller lever 43 via the cam disc 32. Because of this, the opening 49 in the housing 31 is made large enough for each slide disc 42 to make a complete upward and downward movement The projections 47 of the roller levers 43 are made large enough so that the opening 49 is covered in each transverse position of the rod 37, slide ring 42 and the cover means 46.

In order to facilitate movement of the cover means 46 relative to the housing 31, a small clearance 57 is maintained between the projections 47 and the housing parts 48. In addition, the surfaces 55 of the cover means 46 and the opposed surfaces 56 of the housing 31 are slightly curved. This curvature corresponds to the pivotaing motion 51 of the cover means 46 about the journal 40.

In order to open a border thread clamp 41 prior to gripping of a weft thread, a lever 92 is pivotally mounted in the housing 31 on a pin 91 and extends outwardly over a rod 93 of the clamp 41. The lever 92 is actuated in a known manner in order to press the pin 93 downwardly.

In addition to the rod 37 for a clamp 41, a lever 61 (designated a number of times) is pivotally mounted on the journal 40 and extends out of the opening 49. This lever 61 carries a link-on point 67 at the free end to which a shears (not shown) for cutting a weft thread is mounted. In order to actuate the lever 61, the lever 61 has an appendage 63 which carries a roller 64 in contact with the cam disc 33. The lever 61 is under the influence of a spring 65 so that the roller 64 is biased into contact with the cam disc 33. The lever 61 is thus moved in an up and down movement as indicated by the arrow 68 under the action of the cam disc 33.

The shears lever 61 like the rod 37 also carries a cover means 62 in the region of the housing opening 49. This cover means 62 is in the form of a pair of flange projections 69 which define a trapezoidal-shaped enlargement of the lever 61. The projections 69 of the cover means 62 are curved similarly to the projections 47 of the cover means 46 to facilitate pivoting relative to the housing 31.

The shears lever 61 merely pivots about the journal 40 without longitudinal motion. Further, the motions of the rod 37 and lever 61 and synchronized in known manner.

Referring to FIG. 4, wherein like reference characters indicate like parts as above, instead of forming the cover means on the actuating levers, a cover means 80 can be secured on the rod 37. This cover means 80 includes a sleeve 81 which has a flange 82 for covering over the housing opening 49 as well as a pressure spring 83 for biasing the sleeve 81 via the flange 82 against the housing 31. In order to secure the spring 83 in place, a ring 85 is fixed on the rod 37 by any suitable means such as a set screw. In this case, the housing 31 need not have any curved parts about the opening 49 as above described.

Referring to FIG. 5, wherein like reference characters indicate like parts as above, the sleeve 81a is provided with a rounded bore 89 so that the sleeve 81a can roll on the rod 37 during a pivoting motion 51 of the rod 37 in order to prevent jamming of the sleeve 81a against the housing 31.

What is claimed is:

1. In a weaving machine having at least one means for forming a fabric border, said means including a housing having an opening, at least one operating element movably mounted in said housing and extending through said opening and a drive means for moving said operating element transversely of said opening, said drive means extending through said opening; a cover means disposed about said operating element and secured to said drive means for covering over said opening in each transverse position of said operating element.

2. In a weaving machine having at least one means for forming a fabric border, said means including a housing having an opening, a lever pivotally mounted in said housing and extending through said opening into the path of a weft yarn extending across the weaving machine, said lever having a link-on point at a free end to mount a weft-cutting shears thereon and a drive means for moving said operating element transversely of said opening; a cover means integrally disposed on said lever and including a pair of projections defining enlargements of said lever for covering over said opening in each transverse position of said lever.

3. In a weaving machine having at least one means for forming a fabric border, said means including a housing having an opening, at least one operating element movably mounted in said housing and extending through said opening and a drive means for moving said operating element transversely of said opening; a cover means integral with said drive means disposed about said operating element for covering over said opening in each transverse position of said operating element, said cover means including a pair of flange projections defining an enlargement of said drive means and extending over and in facing relation to said opening.

4. In a weaving machine having at least one means for forming a fabric border, said means including a housing having an opening, at least one operating element movably mounted in said housing and extending through said opening and a drive means for moving said operating element transversely of said opening; a cover means having a sleeve disposed about said operating element, a flange on said sleeve for covering over said opening in each transverse position of said operating element, and a spring for biasing said sleeve against said housing.

5. In a weaving machine as set forth in claim 4 wherein said drive means is connected to said operating element to move said element longitudinally of said opening, and said cover means is secured against longitudinal displacement relative to housing.

6. In a weaving machine as set forth in claim 4 wherein said flange bears against said housing about said opening.

7. In a weaving machine as set forth in claim 4 wherein said cover means is located outside said housing.

8. In a weaving machine having at least one means for forming a fabric border, said means including a housing having an opening, at least one operating element movably mounted in saaid housing and extending through said opening and a drive means for moving said operating element transversely of said opening, said drive means including a first pivotally mounted lever extending through said opening for moving said operating element transversely of said opening, a slide ring rotatably mounted in said lever, said slide ring slidably receiving said operating element therein, and a second pivotally mounted lever connected to said operating element to move said element longitudinally of said opening whereby said operating element is guided in said slide ring during transverse and longitudinal movements of said elements; a cover means disposed on said first lever about said operating element for covering over said opening in each transverse position of said operating element.

9. In a weaving machine as set forth in claim 8 wherein said operating element is a rod and wherein said rod caries a border thread clamp at a free end for movement into the path of a weft yarn extending across the weaving machine.

10. In a weaving machine as set forth in claim 8 wherein said slide ring is mounted within said opening.

11. In a weaving machine as set forth in claim 8 wherein said cover means and said housing have curved matching surfaces to permit pivoting of said operating element relative to said housing.

12. In a weaving machine as set forth in claim 11 wherein said surfaces are spaced apart to define a clearance therebetween.

* * * * *